United States Patent [19]

Atkinson et al.

[11] 4,181,309

[45] Jan. 1, 1980

[54] METHOD AND APPARATUS FOR GOLF PRACTICE AND INSTRUCTION

[75] Inventors: Kenneth W. Atkinson, 5 Breeze St., Gulf Breeze, Fla. 32561; C. D. Lowell Longaker, Fort Walton Beach, Fla.

[73] Assignee: Kenneth W. Atkinson, Gulf Breeze, Fla.

[21] Appl. No.: 827,874

[22] Filed: Aug. 26, 1977

[51] Int. Cl.[2] ..... A63B 69/36

[52] U.S. Cl. ..... 273/186 R; 273/201

[58] Field of Search ..... 35/29; 124/3, 49, 31, 124/32, 34, 37, 79, 80, 82; 273/35 R, 26 A, 29 A, 176 K, 183 A, 186 R, 186 RA, 186 A, 186 C, 201

[56] References Cited

U.S. PATENT DOCUMENTS

| | | | |
|---|---|---|---|
| 2,198,968 | 4/1940 | Jewett | 273/201 |
| 2,260,514 | 10/1941 | Duchesne | 273/201 |
| 2,530,698 | 11/1950 | Hogeberg | 273/201 |
| 2,618,480 | 11/1952 | Williams | 273/201 |
| 2,696,985 | 12/1954 | Hogeberg | 273/201 |
| 3,350,102 | 10/1967 | Tiernan | 273/186 RA |
| 3,448,985 | 6/1969 | Scott | 273/201 |
| 3,601,408 | 8/1971 | Wright | 273/186 R |
| 3,738,663 | 6/1973 | Gentiluomo | 273/201 |
| 3,895,366 | 7/1975 | Morris | 273/186 R X |
| 4,021,036 | 5/1977 | Nelson et al. | 273/26 R X |

*Primary Examiner*—Vance Y. Hum

*Attorney, Agent, or Firm*—Albert C. Johnston; Ronald A. Clayton

[57] ABSTRACT

A method of practicing and teaching golf comprises the step of projecting a golf ball into a ball hitting zone during a player's swing of a golf club, while the head of the club is approaching the hitting zone. The ball is projected to arrive in the hitting zone, in the path of the club head, immediately prior to sweep of the head into the zone. The apparatus for practicing and teaching golf comprises a station which provides a hitting zone through which the head of a golf club is swept by a player performing golf swings. A projection device is operable during the player's club swing, while the club head approaches the hitting zone, to strike a ball and thus pop it quickly into the zone in the path of the club head when the head sweeps into the zone.

20 Claims, 6 Drawing Figures

B2
B1
32
46
42
44
40
+
99
TO POWER FROM
RELAY ACTUATED
BY SWING OF CLUB

AMBIENT
LIGHT
+V
48
50
54
56
60
62
66
70
POWER
UNIT
72
68
P
14
46
52
POWER
AMP.
BALL
PROPULSION
SOLENOID
22
58
64
DELAY
ENABLE
INSTRUCTOR'S
CONTROL UNIT
18
46

METHOD AND APPARATUS FOR GOLF PRACTICE AND INSTRUCTION

BACKGROUND OF THE INVENTION

1. Field of the Invention

The present invention relates to method and apparatus for golf practice and instruction. Both the method and apparatus may be used by a golf instructor as an aid in developing a golf student's swing technique or may also be used by the player himself to improve his own swing technique without the assistance of an instructor.

It has been found that most novice golf players have the physical ability to make long, accurate golf shots. In particular, most inexperienced golfers can be taught to properly swing various types of golf clubs with relative ease provided that they are not attempting to actually hit a golf ball. Such "practice" swings can usually be executed with reasonably good form in a relaxed manner. However, when a novice golfer approaches and focuses on a golf ball and concentrates on it in an attempt to actually make a shot, he often tends to swing in a manner entirely different from his practice swing. The difference in the "focused" and "practice" swings may result from tension or excessive concentration by the player on the ball. Golf instructors often attribute the difference between a player's "focused" and "practice" swings to his "hitting at the ball" rather than "swinging through the ball". In either case, the "focused" swing tends to be much poorer than the "practice" swing and, therefore, often results in a poor shot or often in missing the ball entirely. Furthermore, it is difficult for a novice player to know the value of "swinging through the ball" because he often can only do so when he is not actually attempting to hit a ball. Despite conscious effort not to "hit at the ball" he, nevertheless, does so when a ball is in position to be hit.

The method and apparatus of the present invention permits a golf player to strike a golf ball using his more relaxed "practice" swing rather than a tense "focused" swing. Moreover, this method and apparatus permits a golf instructor to observe a student practicing his swing and choose a particular swing with which the student will strike a ball.

2. Description of the Prior Art

Golf has been traditionally taught by instructors who closely observe a student's swing and attempt to modify that swing until it conforms to accepted form. Concentration is devoted to mechanical aspects of the swing which include keeping the leading arm firm, the head down, and leading the swing with the hips. However, frequently the more intense the student's concentration, the more difficult it becomes for him to execute these mechanical aspects. Golf instructional aids have been devised which attempt to correct problems with a golfer's swing form. For example, U.S. Pat. No. 3,918,721 discloses such a device which is intended to constrain certain of the golfer's swing movements to generally accepted form.

Moreover, instructors have identified the problem, common among novice and more experienced golfer's alike, of "hitting at" rather than "swinging through" the ball. However, little has been done to actually demonstrate the different results to be achieved in play to the student.

Various devices for automatically teeing golf balls have also been proposed in the past. Examples of such devices are disclosed in U.S. Pat. Nos. 3,298,694 (Turnau et al.); 3,533,631 (Hladek); 3,549,152 (Gentiluomo); 3,511,507 (Gentiluomo); 1,598,971 (Kenyon); 1,637,537 (Roberts); 2,618,480 (Williams); 2,696,985 (Hogeberg); 2,789,824 (Willcox); 2,838,313 (Mozel); 2,259,916 (Wheeler et al.) and 2,335,280 (Hogeberg). However, the primary purpose of these devices is to convey a golf ball to a tee location automatically. They permit a player to repeatedly make shots without manually teeing a new ball after each shot. They are not concerned with teaching a golf player to improve his swing nor are they designed to permit a novice golf player to use his practice swing to actually hit a shot.

SUMMARY OF THE INVENTION

In a preferred embodiment to be described below in detail, the method and apparatus of the present invention for practicing and teaching golf permit a golf player to actually strike a golf ball with his "practice" swing. As noted above, the practice swing of many golfers tends to be far superior to their swing executed while concentrating on actually hitting a golf ball. Accordingly, the ball may be hit with a golfer's more relaxed swing to execute the best shots within his capability.

In its preferred embodiment, the method of the present invention for practicing golf comprises the step of projecting a golf ball into a ball hitting zone during the course of the player's swing of his golf club while the club head approaches this hitting zone. The ball arrives in the hitting zone in the path of the club head immediately prior to the sweep of the head into the zone. The projecting step is performed after the golfer has begun his swing motion and is completed in such a short time prior to arrival of the club head in the hitting zone that he cannot react by tensing and alter his swing. Thus, the golfer can strike the ball with the smooth motion which he employs during practice and can readily appreciate the value of applying such a smooth swing to actual play.

In the preferred embodiment, the method further comprises the step of detecting the instant of movement of the golf club during the player's swing past a location in its path a predetermined distance backward of the hitting zone. The projecting step is then performed in response to the detecting step and includes projecting the ball into the zone within a predetermined time after the instant of detection.

The apparatus of the present invention, in its preferred embodiment, comprises a station which provides the golf ball hitting zone through which the head of a golf club is swept by a player performing golf swings. A projection apparatus, operable in the course of the player's swing while the club head is approaching the hitting zone, is arranged to project a golf ball into the zone so that the ball will be in the path of the club head when it sweeps into the zone. A photodetector is provided to detect the instant of movement of the club past the predetermined location in its swing path backward of the hitting zone.

In the preferred embodiment the apparatus is selectively operable to project a golf ball into the hitting zone only during a selected swing of a golf club by the player. This swing during which the ball is projected, may be selected by the player himself or by an instructor. For example, an instructor may observe a player and choose a swing which he considers to be closest to ideal. During this chosen, approximately ideal swing he may actuate the apparatus for projecting a ball into the hitting zone in the path of the club head and, thus, demonstrate the value of a smooth swing to the golf player.

Accordingly, it is an object of the invention to provide a method and apparatus for golf practice and instruction that permits a golfer to actually strike a ball using his practice swing rather than using a swing distorted by excessive concentration on properly striking a ball.

Other objects, features and advantages of the present invention will be pointed out in or will be understood from the following detailed description provided below, in conjunction with the accompanying drawings.

DETAILED DESCRIPTION OF THE PREFERRED EMBODIMENTS

Figure 1:
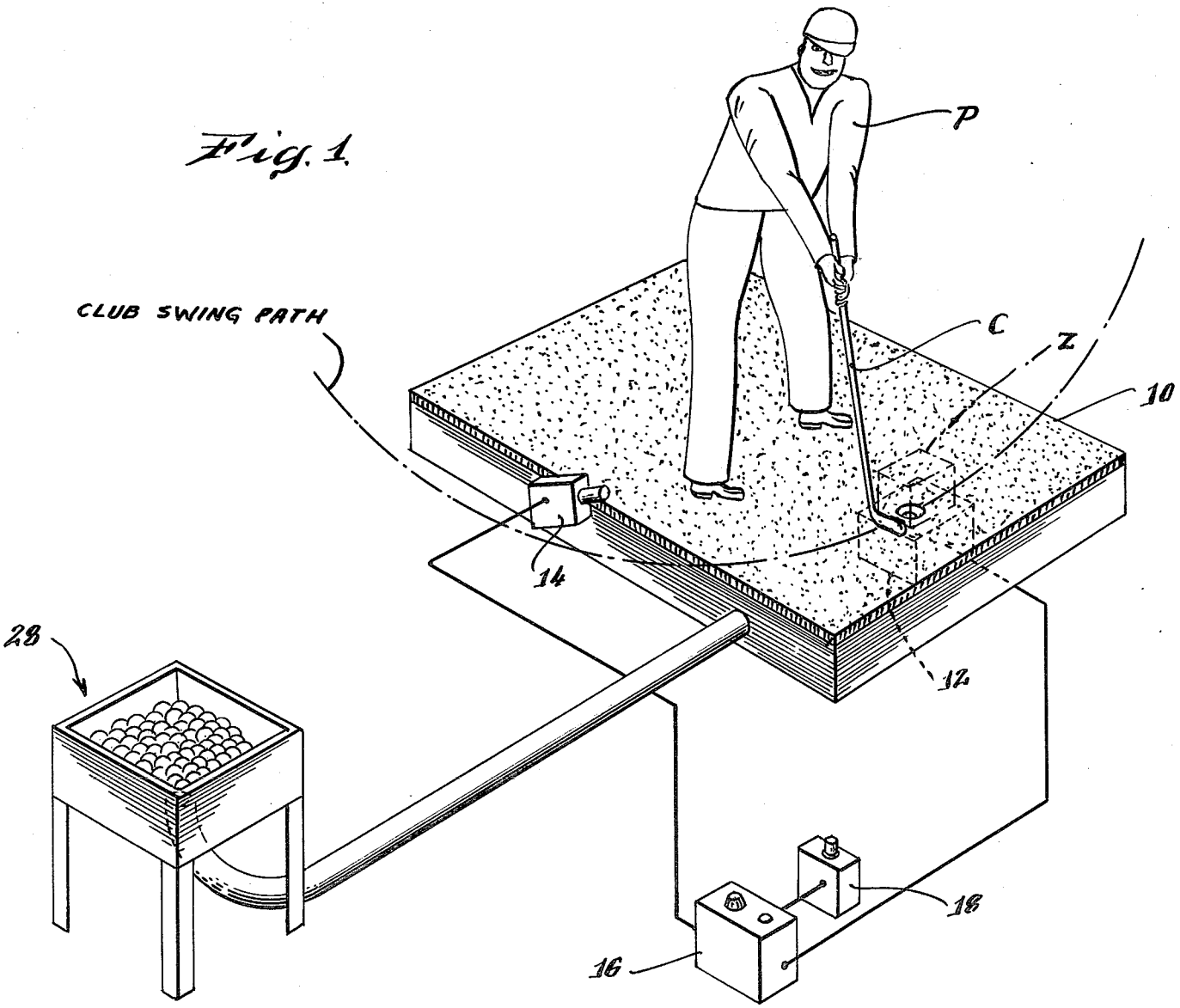
FIG. 1 is a perspective view of an illustrative embodiment of the apparatus of the present invention, illustrating a station which provides a golf ball hitting zone and a player poised to execute swings of his golf club.

FIG. 1 illustrates a golf player P using the apparatus of the present invention to practice golf. The apparatus may be operated by the player himself or by an instructor to teach the player how to properly coordinate movement of a golf club C to execute a correct swing and properly hit a ball for distance and accuracy.

In particular, the apparatus permits the player to hit a ball using his "practice" swing rather than his "focused" swing in a manner to be described in greater detail below.

As shown in FIG. 1, the apparatus comprises a platform 10 which is mounted approximately one foot above ground level. The platform has sufficient area to provide adequate support for the player P and to give him enough room to execute golf swings. A golf ball propulsion unit 12, which will be described in greater detail below, is mounted below the platform to selectively project a golf ball into a hitting zone immediately above the unit, through which the head of a golf club sweeps during club swings by the player. (It will be noted that the platform 10 may be mounted at ground level and the ball propulsion unit 12 may be recessed below ground level if desired).

The apparatus further comprises a photoelectric detector 14 that is aligned and focused to receive light which intersects the swing path defined by the shaft of a club swung by the player. A power unit 16 is connected to both the photoelectric detector 14 and ball propulsion unit 12, to power and coordinate operation of the apparatus in accordance with various events. A control unit 18 is provided through which the apparatus may be selectively actuated by the golf player himself or by an instructor.

Figure 2:
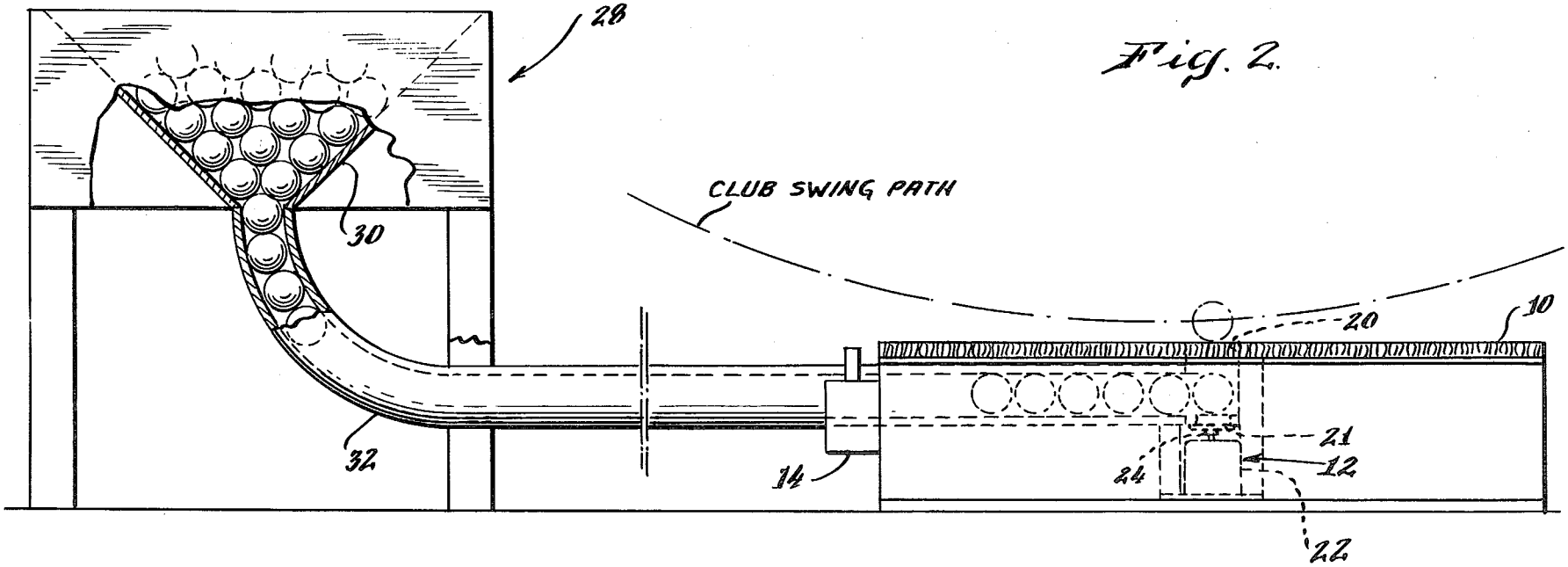
FIG. 2 is a front elevational view of the apparatus of the invention illustrating the photodetector for detecting movement of a golf club past a predetermined location during the golfer's swing and a system for delivering golf balls to a projection device.

The apparatus, which may assist in teaching golf swings of woods, irons, or wedges in accordance with that portion of the game the golf player wishes to improve, is used for golf practice and instruction as follows. A golf player first mounts the platform 10 and positions himself so that when practicing golf swings, the head of his club sweeps through the hitting zone Z immediately above the ball propulsion unit 12. Further, as can be seen in FIGS. 1 and 2, the club shaft passes in its swing path in front of the aligned and focused photodetector so that light incident on it is interrupted during the club swings by the golfer. The photoelectric detector generates a signal, in response to interruption of incident light by a swung golf club, that actuates the ball propulsion unit to project a golf ball into the hitting zone Z where it may be impacted by the head of the moving club.

The control unit 18 is used to selectively enable the apparatus to project a ball into the hitting zone in response to a signal by the photodetector only during a selected practice swing by the player. Specifically, the player may execute several practice swings. However, only after the player achieves a desired degree of comfort in his swings or after he has executed a given number of swings, the form and smoothness of which are acceptable to an instructor or to himself, is the control unit actuated to enable the apparatus to project a ball into the hitting zone. In this manner, swings that are close to ideal for a given golfer may be used to actually strike a golf ball. Since the practice swing is usually better than one in which the player actually tries to strike a ball, his best form is used to execute the shot. This procedure thus demonstrates to the golf player the value of relaxation and smoothness when swinging a club. Further, as will be described in greater detail below, the velocity with which most golf players swing a club and the proximity of the photoelectric detector to the ball projection unit are such that the ball is projected into the hitting zone much too late for the player to alter his swing in response to its arrival in the hitting zone. This feature is of great value in teaching the player in accordance with the principles outlined above.

Figure 3:
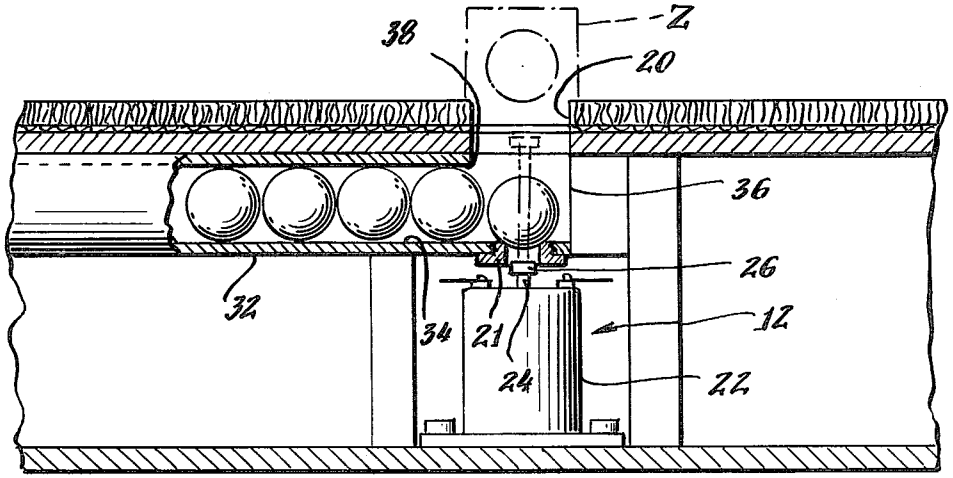
FIG. 3 is an enlarged front elevational view of the device for projecting golf balls into a hitting zone.

As shown in FIGS. 2 and 3, the ball propulsion unit 12 comprises a solenoid 22 that includes an armature 24 having a hard head 26 mounted on its upper projecting end to strike a golf ball. The ball B is cradled in a ball support ring 21 at a location spaced slightly above the head 26. The ring 21 and head 26 register with a hole 20, somewhat larger than the golf ball, formed in platform 10. Upon energization of the solenoid the armature is thrust quickly from a rest position shown in solid lines in FIG. 3 to an extended position shown in phantom lines. When the solenoid is deenergized, the armature returns to the rest position. Energization of the solenoid, as described in greater detail below, causes its armature to be thrust abruptly and rapidly upward so that the head 26 strikes a ball B resting on the support ring 21 and thus propels the ball quickly into the hitting zone Z above the platform 10. If not hit by a club head being swung into zone Z, the ball would fly up through the hitting zone to a height well above it.

The apparatus may also include a system for automatically feeding balls to the support 26 for projection into the ball hitting zone. A suitable ball feeding system, as shown in FIGS. 1, 2 and 3, includes a ball hopper generally indicated at 28, that is mounted at a level above the platform 10. The hopper is formed with a funnel-like insert 30 which channels golf balls to a curved feed tube 32. The tube is pitched slightly to a position under the platform where it leads onto the ball support ring 21 over the head 26 of the armature of the solenoid. As can be seen in FIG. 3, the lower inner surface 34 of the tube 32, which defines a portion of a tube outlet aperture 38, is substantially coextensive with the upper surface of the ball support ring. Accordingly, balls may be channeled by gravity from the hopper 28 through the feed tube 32 directly to the support ring 21 when the armature of the solenoid 22 is in its rest position. Further, a ball-limiting vertical stop 36 is mounted opposite the outlet aperture 38 to prevent movement of a golf ball beyond the support ring.

Figure 4:
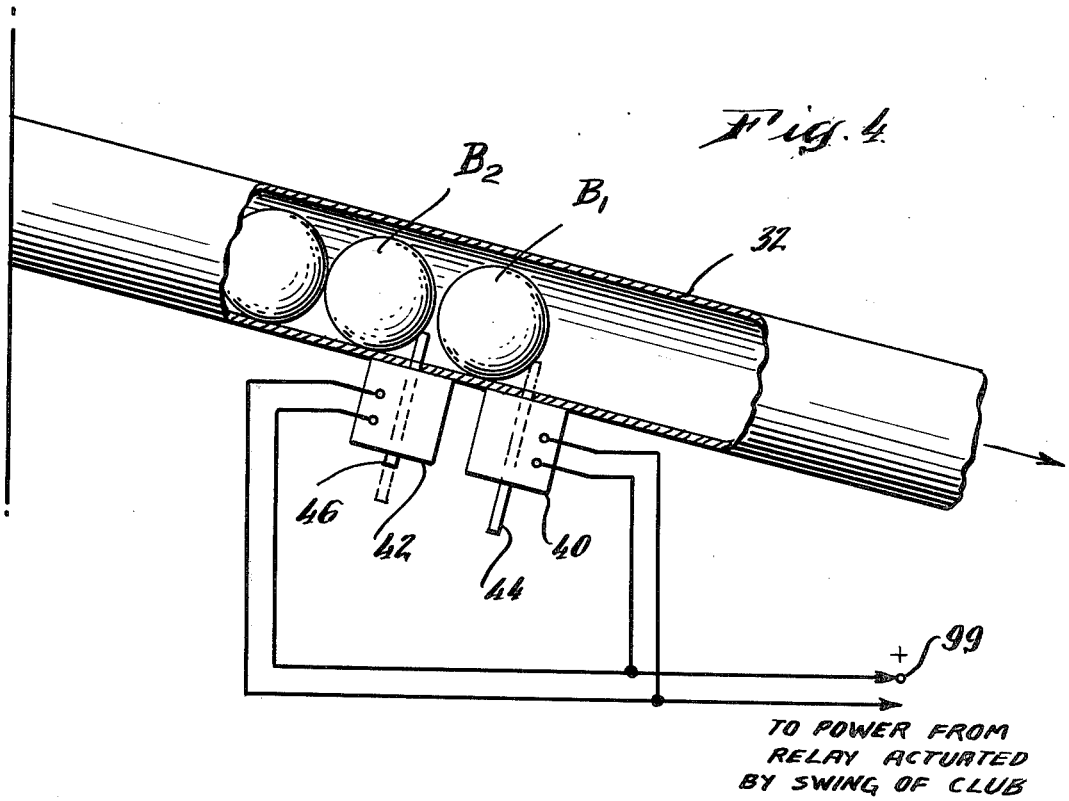
FIG. 4 is a partial cross-sectional view of a device which may be incorporated into the apparatus of the invention for controlling delivery of golf balls to the projection device.

Control of the feeding of balls through the feed tube 32 may be accomplished by apparatus illustrated in FIG. 4. There the pitch of the tube is exaggerated in the interest of clarity. The feed control apparatus comprises two solenoids, the first, 40, of which has an elongated armature 44 which is normally urged to an upwardly projecting position that extends into the interior of the tube 32. Conversely, the second solenoid 42 has an elongated armature 46 which is normally urged to a retracted position withdrawn from the tube interior. Thus, in their deenergized condition, a leading ball $B_1$ is prevented from rolling down feed tube 32 on to the support ring 21 by the projecting armature 44. However, after the device of the present invention has been actuated in a manner to be described in greater detail hereinafter, to project a ball into the hitting zone, the solenoids are energized to retract armature 44 of the first solenoid 40, permitting ball $B_1$ to roll on to the support ring. Simultaneously, the armature 46 of solenoid 42 projects into the interior of the tube 32 to restrain the adjacent ball $B_2$ from movement. However, once ball $B_1$ has reached the support ring, or after another predetermined time, the solenoids are deenergized and are returned to their rest positions with armature 46 retracted from the tube and armature 44 projecting into it. Accordingly, ball $B_2$ rolls to the position occupied by ball $B_1$ in FIG. 4, poised for eventual delivery to the support ring over the main, ball projection solenoid 22.

Figure 5:
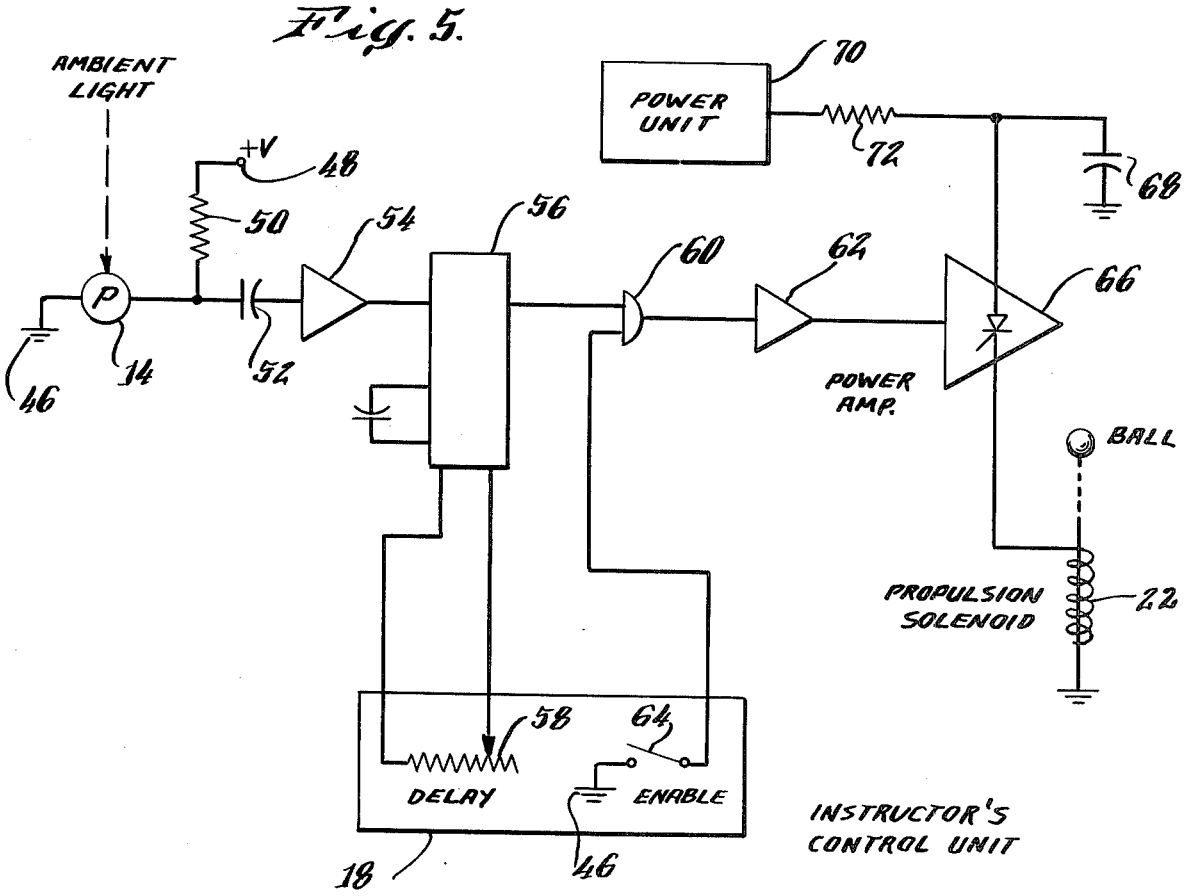
FIG. 5 is a schematic block diagram of a control system for the apparatus of the invention.

The function of the apparatus of the present invention, to project a ball into the hitting zone immediately prior to arrival of a club head therein swung by a golfer, may be explained with reference to the schematic block diagram shown in FIG. 5. As shown there, the apparatus includes the photoelectric detector 14 which is connected between ground 46 and a source of voltage 48. The photodetector is normally heavily saturated and heavily conducting because of its continuous illumination by ambient light. However, when a club shaft being swung by a player reduces the illumination to the photodetector momentarily, current therefrom is reduced to produce a positive-going voltage transient across a photodetector load resistor 50 connected between the photodetector 14 and voltage source 48. The positive-going voltage transient is coupled through a capacitor 52 to an amplifier 54, which may be a conventional multistage saturating amplifier, to be amplified to a standard level. The amplified voltage transient, in turn, triggers a controllable delay generator 56 which may be a monostable multivibrator of conventional design. The delay generator is arranged to introduce a delay of further transmission of the positive-going voltage transient, which may be controlled by either the instructor or by the player himself, over a range sufficient to accommodate different club swing speeds of different players. However, for any given setting of the delay control, the monostable delay introduced by the generator is substantially constant.

The amount of delay introduced by the delay generator 56 is set by a potentiometer 58 mounted in the instructor's control unit 18. The delay should be adjustable over a range of about 1 to 30 milliseconds, a range which is sufficient to accommodate variation in club swing speed for most golfers. This provides, for instance, a period of from 20 to 50 milliseconds from the moment of downswing detection to the moment of hitting.

The delayed output voltage transient from the monostable delay generator is coupled through an AND gate 60 to the input of an output amplifier 62. However, transmission of the voltage transient to the amplifier 62 is dependent upon its concurrence at the AND gate with an enabling signal also conducted from the instructor's control unit 18. In particular, an enabling switch 64 connected through ground 46 to an input to the AND gate 60 is operable by the instructor as noted above to selectively actuate the apparatus only during or for a particular swing by the player (Of course, as noted, the control unit 18 may be arranged for operation by the player himself).

Assuming concurrence of the voltage transient and the enabling signal at the AND gate, the transient is conducted from the output amplifier 62 to the gate of a power amplifier 66 in the form of a silicon controlled rectifier (SCR). The power amplifier 66 is normally non-conducting. However, when it receives the positive-going transient from the remainder of the system, it is rendered conducting to actuate the ball propulsion solenoid 24 in a manner described above.

The electromotive power for actuation of the solenoid 22 is derived from a storage capacitor 68 which is connected to a power unit 70 through a load resistor 72. The power unit, which will be described below, maintains the storage capacitor in a fully charged state. However, when the power amplifier is rendered conducting by a signal from the output amplifier 62, the stored electromotive power is instantly conducted therethrough to the ball propulsion solenoid 22 to cause the solenoid to impart a short, quick impulse to its armature and thus strike a golf ball to "pop" it into the hitting zone.

The control circuit may be equipped to discriminate between slow interruptions of light to the photodetector and a fast interruption of light thereto such as that caused by a swing of a golf club. This may be accomplished by choosing a capacitor 52 which passes only a positive-going voltage transient of shorter than specific duration. In the embodiment illustrated, a single activation of the photodetector circuit can trigger the ball propulsion unit; so the enabling switch should be actuated after the backswing of the player's club. By the provision of a counter in the control circuit, however, the circuit can be modified to respond to more than one signal from the club swing detector. For instance, when two successive voltage transients from the swing detecting circuit are required for actuation of the ball propulsion unit the enabling switch can be operated by the instructor or the player before the player begins the backswing of a full swing selected for hitting a ball.

Figure 6:
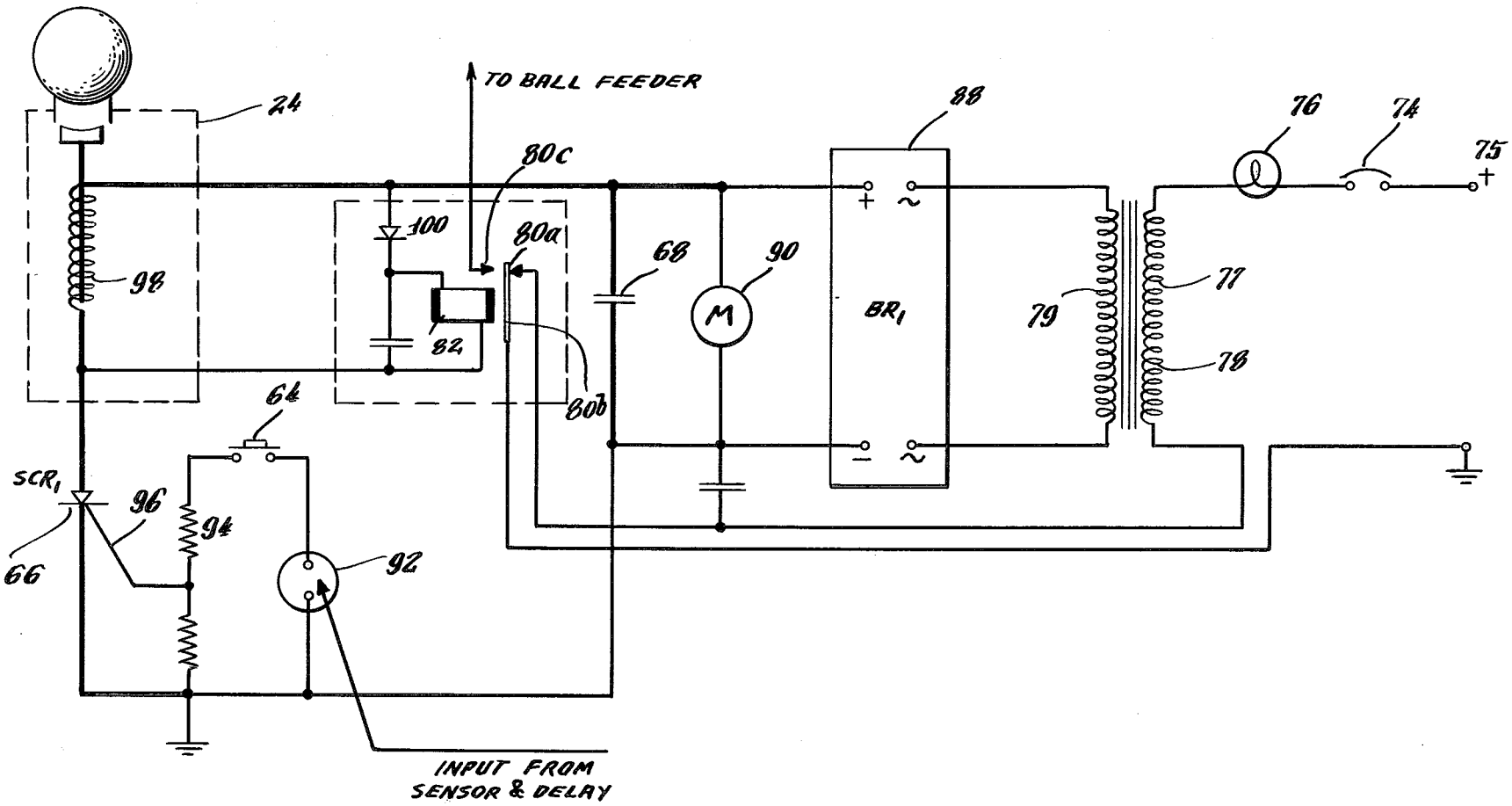
FIG. 6 is a more detailed schematic circuit diagram of the apparatus of the invention.

The components of the power unit 70 and their interconnection with certain other components of the apparatus of the present invention may be described with reference to FIG. 6. The power unit 70 comprises a circuit breaker 74 that may be a master on/off switch from a source of voltage 75, preferably 115 volts A.C. at 60 cycles per second. Further, the circuit breaker provides protection for the circuitry in the event of malfunction. A lamp 76 is connected in series in the circuit breaker circuit with the primary winding 77 of a transformer 78. The lamp provides a resistance path to the primary winding and serves as an indication that the system is "on" condition. The circuit connecting the primary winding of transformer 78 to the voltage source 48 is completed by two normally closed contacts 80*a* and 80*b* of a doublethrow relay 82, the function of which will be described in greater detail below. When the circuit is completed to the primary winding 77, the secondary winding 79 of the transformer 78 supplies current to the input terminals of a bridge rectifier 88, which produces a D.C. voltage that charges the storage capacitor 68. Further, a voltmeter 90 provides a visual indication of when the storage capacitor is properly charged.

When the capacitor 68 is fully charged, an instructor may condition the apparatus for operation as described above. In particular, he depresses the enabling switch 64 before the downswing of a club swing which has been selected for actually hitting a ball, which usually will be a swing made as a practice swing after earlier practice swings have approximated the player's ideal swing. Upon coincidence of the signal produced by closing the enabling switch 64 with reception of the signal from the photodetector, as indicated by the circle 92, the pulse is allowed to pass through resistor 94. The signal is then conducted to the gate 94 of the silicon-controlled rectifier 66, permitting quick discharge of the storage capacitor 68 through the coil 98 of the solenoid 22. Accordingly, the solenoid becomes suddenly energized and will "pop" a golf ball into the hitting zone in the manner described. The propulsion is effected, for instance, within about 20 milliseconds from the moment of actuation of the rectifier 66.

Rendering the silicon-controlled rectifier conducting at coincidence of a signal from the enabling switch with a voltage transient from the photodetector circuitry also energizes the relay 82 through a diode 100 to close the center contact 80*b* against the third of the relay contacts 80*c*. This completed circuit energizes the ball feed control solenoids 40 and 42 through voltage source 99 described with reference to FIG. 4. Simultaneously, it prevents recharging of capacitor 68 until the electromotive power stored therein has been dissipated through relay 82 and solenoid 22. When the charge has been completely dissipated, the contacts 80*a* and 80*b* of relay 82 are restored to their normally closed condition to reenergize storage capacitor 68 for the next cycle of the apparatus of the invention. Typical components suitable for use in the circuit described with reference to FIG. 6 are listed below in Table 1.

TABLE 1

| Component | Manufacturer | Part No, Rating |
|---|---|---|
| Circuit Breaker (74) | Heineman Electric | AM12 KH |
| Appliance Lamp (76) | General Electric | 115v. 40 watt |
| Transformer (78) | Radio Shack | 115v. Pri. 60 Hz |
| Silicon Bridge Rectifier (88) | Any | 200 v. 6 amp. |
| Volt Meter (90) | Any | 100 Volts 1 ma. Full scale |
| Storage Capacitor (Computer Grade) (68) | General Electric | A-9-51502, 14,000 MFD. 60 Volts D.C. |
| Relay (82) | Guardian Electric | A 410-365391-13, 24 Volts D.C., Single pole/Doublethrow |
| Diode, Silicon (100) | Any | 100 Volt, 1 amp. |
| Silicon Controlled Rectifier (66) | Sylvania | ECG5522 |
| Resistor (94) | Any | 240 ohms, 1 watt |
| Solenoid (22) | Any | Automotive Starter Solenoid. Modified |

It will, of course, be appreciated that other components comparable to those listed may be used in the circuit to achieve satisfactory results. It is also to be understood that the photoelectric detector 14 may be a detector arranged opposite a lamp from which a beam of intense light is projected to a detector so that the light beam will be interrupted by the downswing of a club toward the hitting zone.

The apparatus of the present invention described in detail above may be used in accordance with an instructional method for teaching a player to properly execute a golf swing. The apparatus can be used to practice this method which comprises the step of projecting a ball into the hitting zone of a club head in the course of a swing of a golf club while the head is approaching the hitting zone. Further, as noted above, this projecting step is usually performed in the course of a practice swing by the golfer. A particular swing is selected by an instructor or by the player himself as being closest to ideal during a segment of the player's practice session. The instant of movement of the club past a given location in its swing path is detected at a predetermined distance backward of the hitting zone. Moreover, the time between detection of movement of the club past this predetermined location in actual projection of ball into the hitting zone may be set in accordance with the club head speed and the characteristics of the swing executed by the golfer so that a ball arrives in the zone immediately prior to the club head.

It has been found that use of both the method and apparatus of the present invention results in substantial improvement of play by both experienced and inexperienced golfers. Using these aids, the golfer learns the value of swinging his club in a relaxed, smooth fashion. With enough practice, he can learn to use all advantages characteristic of his practice swing for actually playing the game.

Accordingly, although a specific embodiment of the method and apparatus of the present invention have been described above in detail, it is to be understood that this is for purposes of illustration. Modifications may be made to the method and apparatus by those skilled in the art in order to adapt it to particular applications for teaching golf.

We claim:

1. A method of practicing golf comprising in the course of a player's swing of a golf club, while the head of the club is approaching a golf ball hitting zone, detecting the instant of movement of the club past a location in its swing path at a predetermined distance backward of the hitting zone, and striking a golf ball and thus projecting it by free flight into the hitting zone so that it enters into said zone into the path of the club head sweeping through said zone within a predetermined time after said instant.

2. A method according to claim 1, said striking and projecting of the ball being effected in response to the downswing of the club toward said zone.

3. A method according to claim 1, said predetermined time being within the range of 20 to 50 milliseconds for arrival of the ball in said zone.

4. A method according to claim 1 wherein a player performs practice swings of the club through the hitting zone with no ball present and said striking and projecting of the ball is effected selectively to propel a ball into said zone in the course of a swing being executed as such a practice swing.

5. A method of practicing golf wherein a player performs practice swings of a golf club causing the head of the club to sweep through a hitting zone with no ball present in the zone, said method comprising, in the course of a swing being executed as such a practice swing:

detecting the instant of movement of the club past a location in its swing path at a predetermined distance backward of said zone, and while the club head is approaching the hitting zone, striking a golf ball and thus projecting it by free flight into said zone so that the ball within a predetermined time after said instant will be in the path of the club head as the club head sweeps into said zone, said time having been set in accordance with an observed speed of the club head movement toward said zone in the player's practice swings.

6. An apparatus for practicing golf, comprising:

a station providing a golf ball hitting zone through which the head of a golf club is swept by a player performing golf swings, means operable in the course of a player's swing of a club for striking a golf ball and thus projecting it by free flight into said zone, and means actuated in response to the player's downswing of the club toward the hitting zone for activating said means for projecting the ball into said zone, said activating means including means for detecting the instant of movement of the club past a location in its swing path at a predetermined distance backward of the hitting zone, and means actuated by said detecting means for activating said projecting means so that a ball will enter into said zone within a preset time after said instant and will be in the path of the club head when the club head sweeps into said zone.

7. Apparatus according to claim 6, further comprising:

means operable selectively for activating said projecting means in the course only of a selected swing of the club by the player.

8. Apparatus according to claim 6, further comprising:

adjustable time delay means for setting said time in accordance with an observed speed of the player's swing of the club head toward said zone.

9. Apparatus according to claim 6 wherein said detecting means includes photodetector means for generating a signal in response to a downswing of the club past said location and said projecting means includes:

an electrically operable propulsion unit for striking a ball, power means for accumulating electrical motive power to operate said unit, gate means operable to transmit said power, and variably settable time delay means for operating said gate means at a preset instant after the generation of said signal.

10. Apparatus according to claim 9 wherein said photodetector means includes:

a photocell for generating a signal pulse in response to said downswing, and means for amplifying said pulse to form said signal.

11. Apparatus according to claim 9 wherein said time delay means comprises a monostable multivibrator.

12. Apparatus according to claim 9 wherein said propelling means further includes:

means selectively operable by an observer of the player's swing for generating an enabling signal, and an AND gate operable to actuate said gate means by the concurrence of an input to said AND gate from said enabling means and an input thereto from said time delay means.

13. Apparatus according to claim 9 wherein said power means includes a capacitor for storing said motive power, said gate means includes a silicon controlled rectifier for conducting power from said capacitor to said propulsion unit and an AND gate responsive to a signal from said time delay means for rendering said rectifier conductive.

14. Apparatus according to claim 9 wherein said propulsion unit comprises a solenoid mounted beneath said hitting zone and having a generally vertically disposed armature provided with a head for striking a golf ball disposed thereover, said armature being operable by energization of said solenoid to pop such a ball rapidly upwardly into said hitting zone.

15. An apparatus for practicing golf comprising:

A. a station providing a golf ball hitting zone through which the head of a golf club is swept by a player performing golf swings, B. a photodetector for detecting the instant of movement of the club past a location in its swing path a predetermined distance backward of the hitting zone, and for generating a signal in response to the detection at said instant, and C. means operable within a preset time after said instant, in the course of the player's swing of a club, while the head of the club is approaching the hitting zone, for projecting a ball into said zone so that the ball will be in the path of the club head when the club head sweeps into said zone, said projecting means including:

an electrically operable propulsion unit for projecting a ball into said zone, power means for accumulating electromotive power to operate said unit, gate means operable to transmit said power, and adjustable time delay means for setting said preset time in accordance with an observed speed of the player's swing of the club head toward said zone and for, thereby, operating said gate means at the preset time after the generation of said signal by said photodetector.

16. Apparatus according to claim 15, further comprising means operable selectively for activating said projecting means in the course only of a selected swing of the club by the player.

17. Apparatus according to claim 15 wherein said photodetector means includes:

a photocell for generating a signal pulse in response to said downswing, and means for amplifying said pulse to form said signal.

18. Apparatus according to claim 15 wherein said time delay means comprises a monostable multivibrator.

19. Apparatus according to claim 15 wherein said propelling means further includes:

means selectively operable by an observer of the player's swing for generating an enabling signal, and an AND gate operable to actuate said gate means by the concurrence of an input to said AND gate from said enabling means and an input thereto from said time delay means.

20. Apparatus according to claim 15 wherein said power means includes a capacitor for storing said motive power, said gate means including a silicon controlled rectifier for conducting power from said capacitor to said propulsion unit and an AND gate responsive to a signal from said time delay means for rendering said rectifier conductive.

* * * * *